United States Patent [19]

Salam

[11] Patent Number: 4,466,207

[45] Date of Patent: Aug. 21, 1984

[54] INFORMATION DISPLAY DEVICES

[75] Inventor: Hassan P. A. Salam, London, England

[73] Assignee: Unisplay S.A., Geneva, Switzerland

[21] Appl. No.: 320,480

[22] Filed: Nov. 12, 1981

[51] Int. Cl.[3] ..... G09F 9/00

[52] U.S. Cl. ..... 40/449; 40/452; 40/463; 340/815.27

[58] Field of Search ..... 40/446, 447, 449, 450, 40/451, 452, 463; 340/815.01, 815.04, 815.05, 815.06, 815.08, 815.09, 815.27

[56] References Cited

U.S. PATENT DOCUMENTS

| | | | |
|---|---|---|---|
| 3,995,386 | 12/1976 | Salam | 40/449 |
| 4,006,476 | 2/1977 | Romney | 340/815.27 |
| 4,115,941 | 9/1978 | Stephenson | 40/452 |
| 4,163,332 | 8/1979 | Salam | 40/463 |
| 4,323,889 | 4/1982 | Salam | 340/373 |

FOREIGN PATENT DOCUMENTS

| | | | |
|---|---|---|---|
| 771356 | 11/1967 | Canada | 40/449 |
| 1414460 | 11/1975 | United Kingdom | 40/449 |

*Primary Examiner*—Gene Mancene
*Assistant Examiner*—James Hakomaki
*Attorney, Agent, or Firm*—Laubscher, Philpitt & Laubscher

[57] ABSTRACT

A stationary matrix panel has magnetic display elements arranged in vertical and horizontal rows, each element having two stable states of contrasting appearance. Electromagnetic actuator heads are mechanically coupled together by resilient couplings so as to move in unison and actuate selected display elements. The couplings are arranged to allow limited movement in a direction normal to that of the travel of the actuator heads across the matrix panel, thereby allowing for slight misalignment in the panel. Each actuator head contains a number of individual electromagnets and is responsive to a respective indexing track which provides signals indicative of the actual position of the actuation of the electromagnets in the head. The matrix panel has a plurality of guide rails arranged to provide accurate vertical registration of the heads, each guide rail being slotted to provide the indexing. In one embodiment the matrix panel is made of a two-dimensional array of matrix units each having a two-dimensional array of display elements and each providing as an integral part thereof a portion of a guide track and a portion of an indexing track.

17 Claims, 8 Drawing Figures

Fig. 4
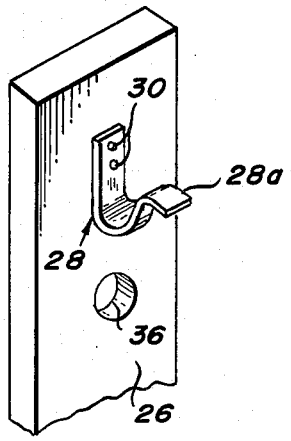
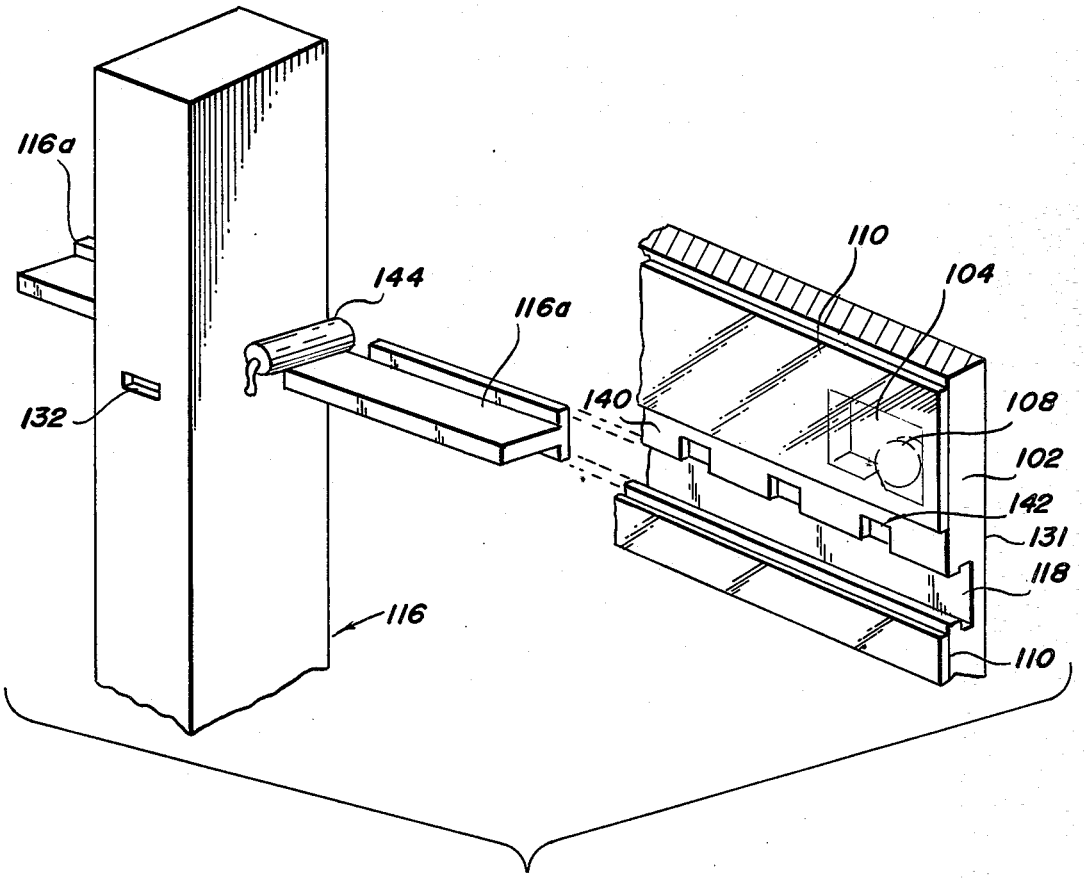
Fig. 5

INFORMATION DISPLAY DEVICES

BACKGROUND OF THE INVENTION

This invention concerns information display devices of the kind in which a "writing" head carrying a set of actuators such as electromagnets is moved relative to a stationary matrix of correspondingly actuatable display elements, such as magnetically actuatable elements, so as to alter the appearance of selected elements, as disclosed, for example, in Salam U.S. Pat. No. 3,562,938.

It is an object of the present invention to facilitate the manufacture of matrix display devices having a large number of display elements, for example 500 rows by 2,000 columns, so as to be able to display more information and to show pictures in fine detail. In certain applications, it is desirable to have a high density of display elements, for example 50–100 per square inch, and the invention facilitates the manufacture of large matrices with such high densities.

Another object of the invention is to provide accurate registration between the actuating electromagnets and the display elements.

BRIEF DESCRIPTION OF THE FIGURES

Other features and advantages of the invention will become apparent from the following description of embodiments thereof, when taken in conjunction with the following drawings, in which:

FIG. 4 is a detailed perspective view of part of the guide and registration means shown in FIG. 3;

FIG. 5 is a partially exploded rear perspective view of details of a second embodiment of the invention, similar to that of FIG. 1 but differing in the type of guide and indexing arrangements used;

DETAILED DESCRIPTION

The various embodiments of the invention are shown as including display elements of the type described in the aforementioned U.S. Pat. No. 3,562,938, but any other type of display element actuated by a moving writing head having an actuator for each row of display elements can be used instead.

The arrangements described hereinafter provide improved means of registration between the actuating electromagnets of the writing head and the magnetically actuatable display elements, as well as improved timing of actuation of the electromagnets with reference to their actual positions in relation to the display elements.

Figure 1:
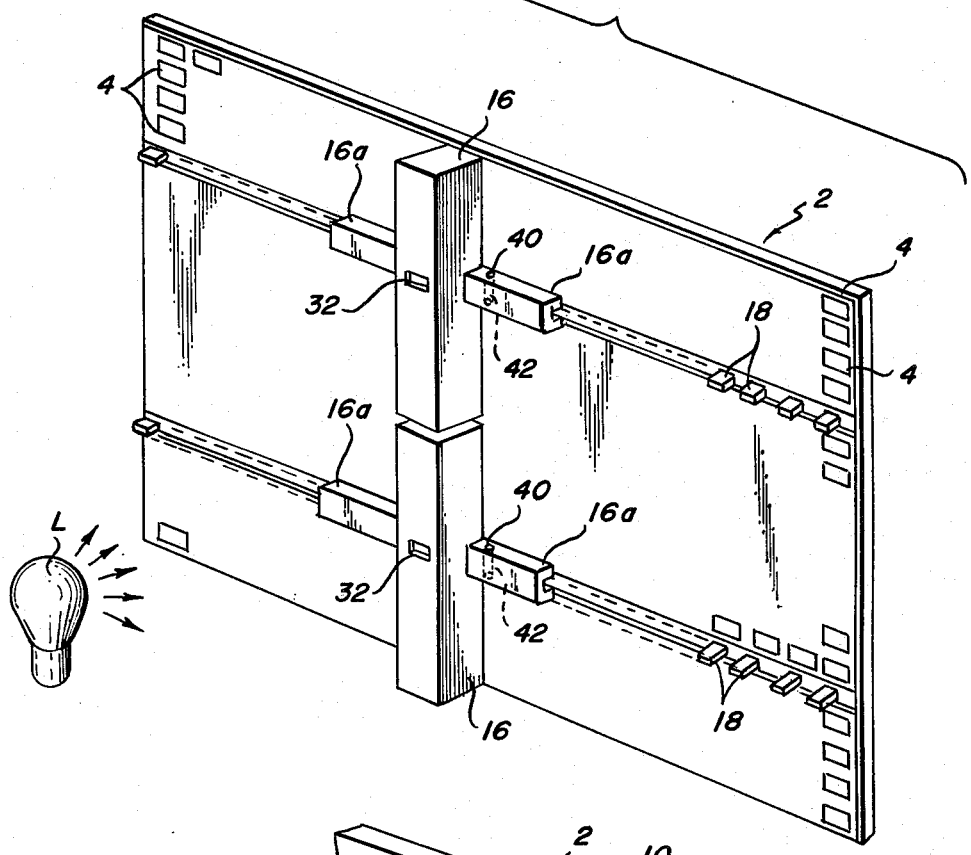
FIG. 1 is a rear perspective view of details of one embodiment of the invention.
Figure 2:
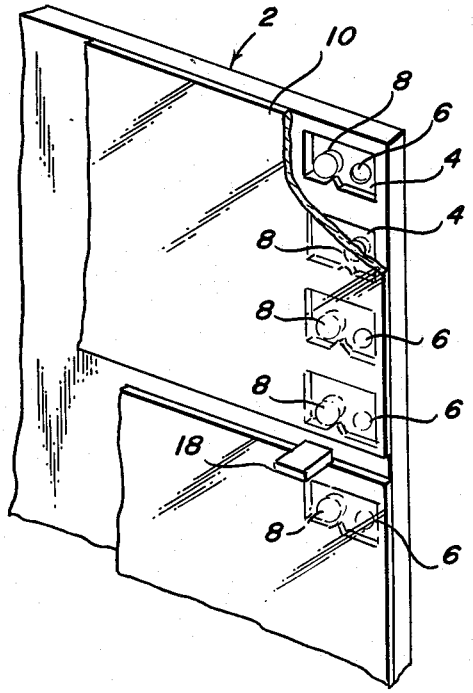
FIG. 2 is a magnified partially cut-away view of part of the embodiment of FIG. 1.

Referring first more particularly to FIGS. 1–4, the information display apparatus according to one embodiment of the present invention includes a base plate 2 that is formed from a suitable opaque synthetic plastics material, such as acetal or polyethylene, in which are integrally molded a plurality of small cell chambers 4 each having a light-transmitting aperture 6, as shown in FIG. 2. Mounted for displacement between bistable light-transmitting and light-blocking positions relative to the aperture 6 of each cell chamber 4 is an electromagnetically actuatable shutter member 8. A transparent or translucent sheet 10 secured to the rear face of the base plate 2 retains the shutter members in their respective cell chambers 4. The cells are of relatively small size and are arranged in horizontal rows and vertical columns. Thus, light emitted from the light source L arranged to the rear of the matrix passes through those apertures 6 that are not obstructed by the associated shutter members 8, and consequently a visual array is presented on the front surface of the matrix base plate 2.

Figure 3:
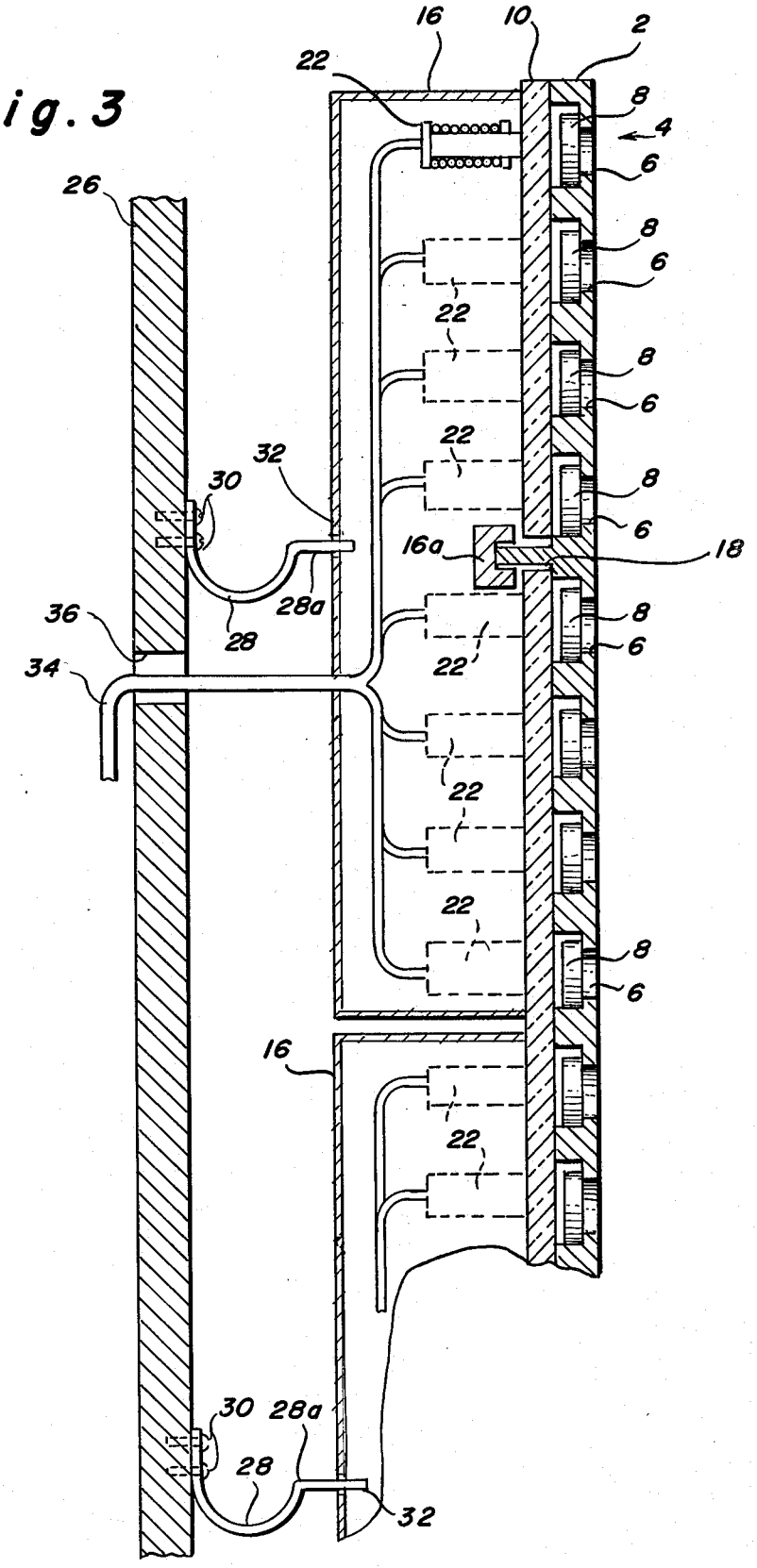
FIG. 3 is a sectional side view of the embodiment of FIGS. 1 and 2 including improved guide and registration means.

Electromagnetic head means 16 for selectively operating the shutter members between their light-transmitting and light-blocking positions are mounted for horizontal displacement by improved guide means. More particularly, in the embodiment of FIGS. 1–4, a pair of electromagnetic heads 16 are provided that are guided for horizontal linear displacement upon flat horizontal projections 18 that extend rearwardly from the rear surface of the matrix base plate unit 2 as shown in FIGS. 1–3. For slidably mounting the electromagnetic head means on the guide projections 18, the head means are provided with lateral extensions 16*a* of generally U-shaped cross section, thereby to receive the guide projections 18 as shown in FIG. 3. Each electromagnetic head contains a plurality of electromagnets 22 each of which is disposed opposite the corresponding horizontal row of cells 4, the electromagnets being selectively energizable via conventional coil energizing circuits, as is known in the art.

In order to displace the electromagnet heads 16 simultaneously in linear directions contained in the plane parallel with the plane of the matrix 2, a common drive operator bar 26 is provided, as shown in FIGS. 3 and 4. The common drive bar 26 is resiliently connected with the electromagnetic head bodies 16 via resilient connecting springs 28, thereby coupling them together and permitting a degree of movement between the drive bar 26 and the electromagnet heads 16, which heads are guided against vertical displacement by the horizontally arranged projections 18. At one end, the connecting springs 28 are fastened to the drive bar 26 by screws 30, and at their other ends, the springs have projecting foot portions 28*a* that extend into corresponding slits 32 contained in the rear surface of the electromagnet heads 16. The springs 28 press the heads 16 lightly against the matrix panel 2. They also allow slight motion of the heads 16 up and down relative to the drive bar 26. The energizing cables 34 containing the conductors leading to the coil energizing circuits extend through corresponding openings 36 contained in the common drive bar 26. The spaces between the uniformly-spaced horizontal guide projections 18 constitute index marks for accurately determining the column positions being scanned by the electromagnet heads 16 along the guide means, and to this end the lateral extensions 16*a* of the head members include light sources 40 and light receivers 42 arranged on opposite sides of the rearwardly extending guide projections 18, whereby light pulses may be detected by the light receivers 42 for indexing the electromagnet heads 16 relative to the matrix base plate 2. As each of the heads 16 traverses a column of display elements 4 its light receiver 42 provides a timing signal for the head which is independent of the positions of the other heads. This timing signal is used to control the timing of energization of the electromagnets on the head. Thus if drive bar 26 is slightly skewed relative to the columns of the matrix causing the heads to be out of line with each other the skew will not affect the correct timing of energization of the coils in the different heads.

Projections 18 are made thin to enable the distance between the row immediately above them and that immediately below them to be substantially the same as the distance between adjacent rows elsewhere. They are arranged so that they protrude from the rear surface of base 2 by a distance that is less than the distance from the center of a cell to that of the one above it and so that the gaps between them are in line with the columns of apertures 6 in the cells (see FIG. 2), so as to maintain substantially uniform illumination of the apertures. The back illumination L can be by means of elongate fluorescent lamps or tungsten bulbs.

Referring to the embodiment of FIG. 5, the guide means for each head 116 comprises a tongue and groove connection, the tongues being defined by lateral extensions 116*a* attached to head 116 that are slidably received in a corresponding groove 118 contained in the rear surface of the opaque base plate 102. In order to provide the appropriate index marks in this embodiment, the rear surface of the matrix base plate 102 is provided with a metallized strip 140 that contains uniformly spaced openings 142 that define the index marks. The metallized areas on opposite sides of the gaps 142 are sensed by a metal detector sensing element 144 that is carried by the indexing head 116.

Figure 6:
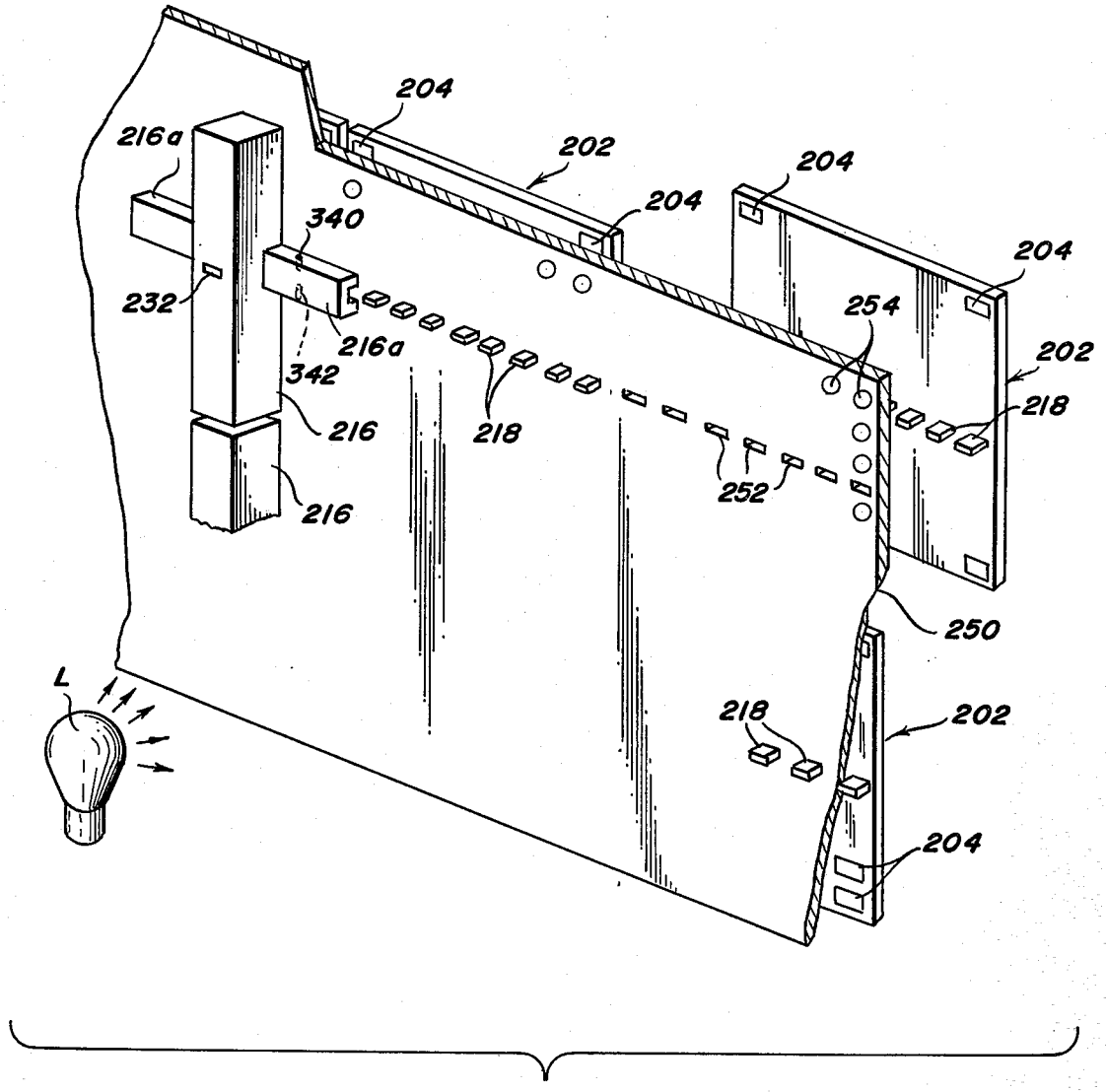
FIG. 6 is a partially exploded rear perspective view of a third embodiment similar to that of FIG. 1 but including a modular construction feature.

Referring now to the embodiment of FIG. 6, a support sheet 250 is provided for removably supporting a plurality of modular matrix units 202 which may be formed by injection moulding. To this end, the relatively thin support sheet 250 contains apertures 252 for receiving horizontal rearwardly extending projections 218 extending from matrix units 202, thereby affording a plug-in connection by means of which a plurality of the matrix units 202 may be mounted in coplanar fashion upon the front face of the support sheet 250. The length of the guide projections 218 is greater than the thickness of the support sheet 250, so that the projections extend completely through and terminate at their rearward ends beyond the apertures 252 in the support sheet, whereupon the free rear extremities of the projections define the guide means upon which the channel portions 216*a* of the electromagnet heads 216 are guided. The sheet 250 may be formed of a transparent material (for example, a synthetic plastic transparent sheet), or may be formed as an opaque material provided with transparent areas 254 directly opposite the respective cells 204, whereby light from the light source L will pass through the transparent zones 254 and through those cells in which the shutter elements are in the light-transmitting positions.

Figure 8:
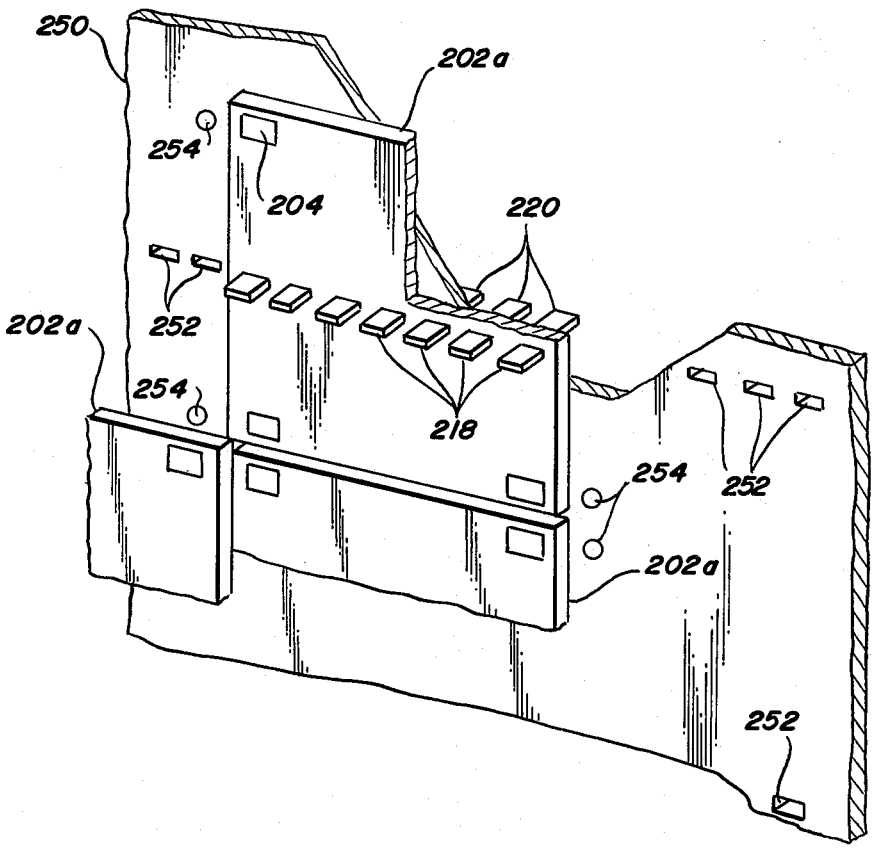
FIG. 8 is a partially cut-away view of a fifth embodiment of the invention.

The matrix units can be adapted to plug into support sheet 250 from the rear instead of from the front. FIG. 8 shows a matrix unit 202*a* adapted for this purpose. It has protrusions 220, opposite protrusions 218, that plug into apertures 252. The moving head rides on protrusion 218, as in FIG. 6.

The arrangements described with reference to FIGS. 6 and 8 can be very large, being limited only by the size of sheet 250. There is therefore provided a simple method of making very large matrices, as well as a method of achieving good registration between the electromagnets and the display elements.

Figure 7:
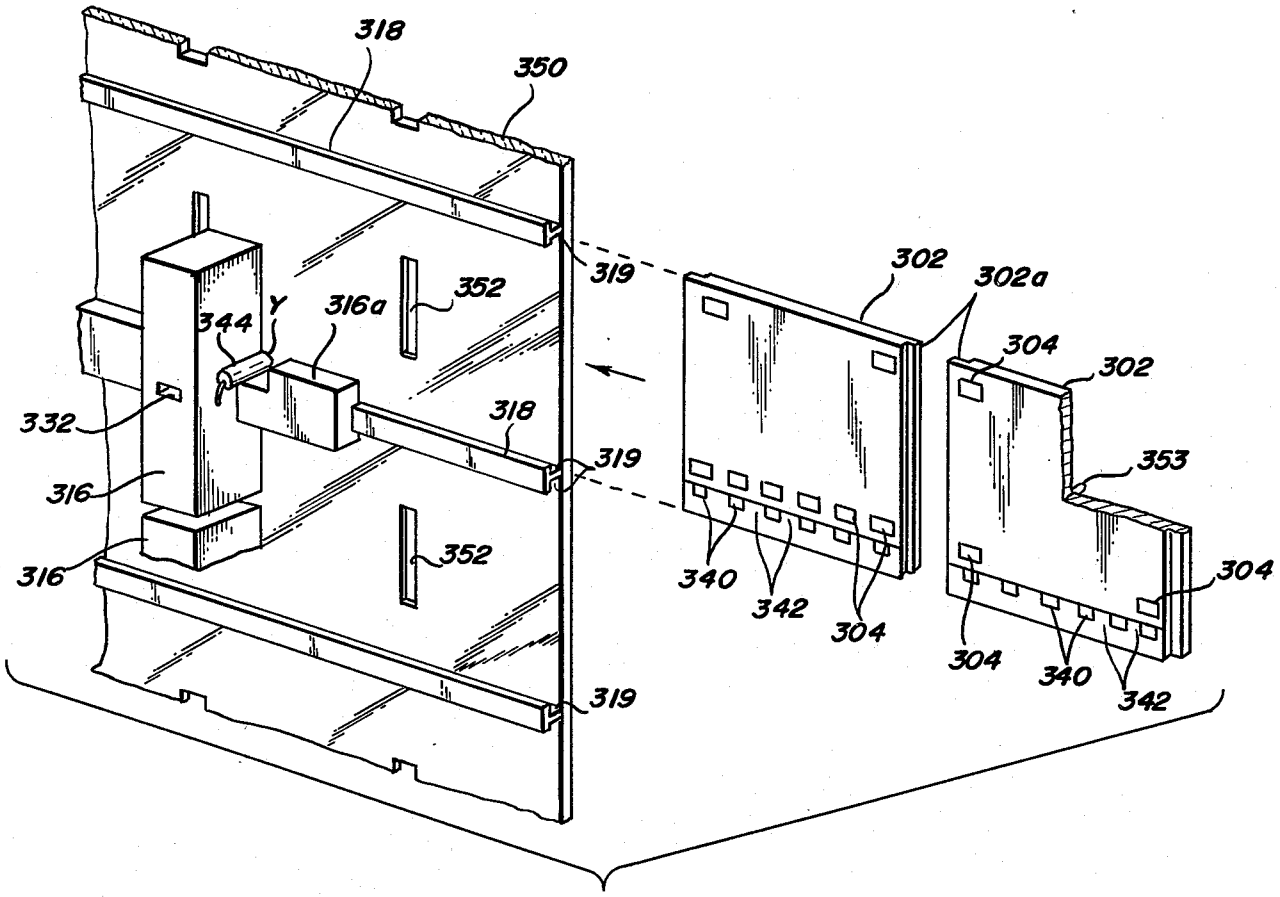
FIG. 7 is a partially exploded rear perspective view of a fourth embodiment of the invention.

Referring now to the embodiments of FIG. 7, the matrix units 302 are removably connected with the rear surface of a transparent support sheet 350 by means of opaque guide rails 318 having a T-shaped cross-section forming grooves 319 into which matrix units 302 are slid from the side. The guide rails 318 also provide surfaces upon which the electromagnet heads 316 are slidably mounted. More particularly, the matrix units 302 are mounted between the electromagnet heads 316 and the support sheet 350, which matrix units are accurately supported in place by means of shallow or removable pins 353 that are adapted to extend forwardly from the matrix units 302 through locating slots 352 contained in the support sheet 350. In this embodiment, the rear surfaces of the matrix devices 302 are provided with a plurality of equally spaced metallized portions 340 that define indexing marks that are sensed by a metal detector sensor 344 carried by each electromagnet head 316. In order to prevent the transmission of light rays between the adjacent matrix units 302, the matrix units are provided at their lateral edge with overlapping flange portions 302*a*.

Thus, in the embodiments of FIGS. 6, 7 and 8, a plurality of interchangeable matrix units may be removably connected with fixed support sheet for operation by the electromagnet heads to selectively place the shutter elements of the various cells in either the light-transmitting or light-blocking positions as desired. Alternatively the matrix units can be permanently bonded to the support sheet.

The arrangements in FIGS. 6 and 8 can be modified so that each matrix unit has two or more guide rows, just as the matrix unit in FIG. 1 can have multiple guide rows.

In the embodiments of FIGS. 6 and 8, the moving heads are sprung towards the matrix, as in the case of FIG. 1. In the arrangement in FIG. 7, they can be sprung or alternatively guide means 316*a* attached to heads 316 and rail 318 can be modified to provide a sliding arrangement, such as that already described with reference to FIG. 5, which prevents relative motion between head 316 and matrix unit 302 in the direction normal to the plane of the matrix.

The dimensions of the arrangement in FIG. 7 can be as extensive as extrusion manufacturing methods allow. It is not necessary for the distance between adjacent rails to be extremely accurate, or for the rails to be extremely straight. Because each locating slot 352 is a long vertical slot and is arranged to receive a pin 353, the vertical position of the slots 352 relative to the rails 318 is not very critical. In this way manufacturing tolerances can be relaxed and consequently manufacturing costs reduced.

It is not necessary for head section 316 to be guided along a single central rail; it can have guide means top and bottom and run between a pair of guide rails.

The various embodiments of the invention have been described with reference to head sections moving horizontally and having an electromagnet per row of display elements. Other arrangements can be used such as head sections moving vertically and being guided by vertical rails. Although generally two actuating heads have been shown and described with reference to the various embodiments, a greater number will usually be provided, each in association with its own row of index markers.

In summary therefore, there have been disclosed arrangements of display devices comprising matrix panels which have magnetic display elements arranged in vertical and horizontal rows, each element having two stable states of contrasting appearance. Electromagnetic actuator heads are mechanically coupled together by resilient couplings so as to move in unison and actuate selected display elements. The couplings are arranged to allow limited movement in a direction normal to that of the travel of the actuator heads across the matrix panel, thereby allowing for slight misalignment in the panel. Each actuator head contains a number of individual electromagnets and is responsive to a respective indexing track which provides signals indicative of actual position of the individual head so as to improve the timing of the actuation of the electromagnets in the head.

What is claimed is:

1. A display device, comprising (a) a matrix panel (2, 102, 202, 302) containing a plurality of display elements (4, 104, 204, 304) arranged in horizontal and vertical rows to define said matrix, each of said display elements having first and second contrasting states;

(b) at least two actuating head means (16, 116, 216, 316) arranged adjacent one side of said panel for controlling corresponding groups of said display elements, respectively, said groups being arranged relative to each other in a first direction corresponding with one of said horizontal and vertical rows of said matrix, each of said head means being further operable to individually selectively control the state of each element of its corresponding said group;

(c) drive means (26) for displacing said head means relative to said panel in a second direction normal to said first direction;

(d) resilient means (28) for coupling said head means with said drive means, whereby said head means are displaced in unison by said drive means, said resilient coupling means affording relative displacement between said head means in said first direction; and (e) at least two guide means (18, 118, 218, 318) connected with said matrix panel in spaced relation and extending in said second direction, each of said guide means being operable to independently guide a corresponding one of said head means, respectively, during movement of said head means in said second direction, whereby said guide means maintain said head means in alignment with said respective groups of display elements arranged in said first direction during movement of said head means in said second direction.

2. A device as defined in claim 1 wherein said matrix panel includes an assembly of individual matrix units each having an array of said display elements.

3. A device as defined in claim 2 wherein said panel includes a two-dimensional array of said matrix units.

4. A device as defined in claim 2 wherein said matrix units include guide members forming part of said guide means.

5. A device as defined in claim 2 wherein a said matrix unit includes a row of index marks.

6. A device as defined in claim 2 wherein there is provided a common support sheet and means connecting a plurality of said matrix units thereto.

7. A device as defined in claim 6 wherein said connecting means includes dowel means fitting through said support sheet.

8. A device as defined in claim 7 wherein portions of said dowel means constitute a said guide means.

9. A device as defined in claim 6 wherein at least those portions of said sheet opposite said display elements are transparent.

10. A device as defined in claim 1, wherein said matrix panel includes at least one row of indexing markers and further wherein said actuating head means includes sensor means (40, 42, 144, 340, 342, 344) for sensing said markers.

11. A device as defined in claim 1, wherein said actuating head means includes bearing means (*6a, 116a, 216a, 316a*) cooperating with said guide means.

12. A device as defined in claim 11, wherein said guide means contains a plurality of spaced slots defining indexing markers, and further wherein said actuating head means includes sensor means for sensing said slots.

13. A device as defined in claim 1, wherein said guide means is arranged between an adjacent pair of said rows.

14. A device as defined in claim 13, wherein the distance between said pair of rows having said guide means therebetween is substantially the same as the distance between the remaining adjacent pairs of rows.

15. A display device, comprising (a) a matrix panel containing a substantially uniform array of electromagnetically actuable display elements arranged in rows having vertical and horizontal directions, said display elements having first and second contrasting states;

(b) at least two electromagnetic head means arranged adjacent one side of said panel for selectively controlling the individual elements of at least two corresponding groups of said display elements, respectively, said groups being arranged relative to each other in a first direction corresponding with one of said vertical and horizontal directions;

(c) drive means for displacing said head means relative to said panel in a second direction normal to said first direction;

(d) resilient means for coupling said head means with said drive means;

(e) at least two indexing guide means connected with said panel in spaced relation and extending in said second direction to guide a corresponding one of said head means, respectively, during movement of said head means in said second direction, each of said indexing means comprising a row of index elements; and (f) at least two sensor means connected with said head means, respectively, each of said sensor means being arranged adjacent one of said indexing means, respectively, each of said sensor means being operable to produce a signal in response to the sensing of said respective indexing means, the timing of energization of said electromagnetic head means being controlled by said signals from said respective sensor means, thereby to provide accurate timing of the energization of said head means.

16. A display device as defined in claim 15 wherein a single member is formed to provide said rows of index elements.

17. A display device as defined in claim 15 wherein said substantially uniform array is constructed using a plurality of individual matrix units each including an array of said display elements.

* * * * *